US009599060B2

(12) United States Patent
Sanborn et al.

(10) Patent No.: US 9,599,060 B2
(45) Date of Patent: Mar. 21, 2017

(54) METHOD FOR OPERATING A FUEL INJECTION SYSTEM

(71) Applicant: Ford Global Technologies, LLC, Dearborn, MI (US)

(72) Inventors: Ethan D. Sanborn, Saline, MI (US); Joseph Lyle Thomas, Kimball, MI (US); Daniel Dusa, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 48 days.

(21) Appl. No.: 14/805,139

(22) Filed: Jul. 21, 2015

(65) Prior Publication Data

US 2017/0022927 A1 Jan. 26, 2017

(51) Int. Cl.

| | |
|---|---|
| ***F02D 41/38*** | (2006.01) |
| ***F02D 41/26*** | (2006.01) |
| ***F02D 41/24*** | (2006.01) |
| ***F02M 55/02*** | (2006.01) |
| ***F02M 59/20*** | (2006.01) |

(52) U.S. Cl.

CPC ..... *F02D 41/3845* (2013.01); *F02D 41/2406* (2013.01); *F02D 41/26* (2013.01); *F02M 55/025* (2013.01); *F02M 59/20* (2013.01); *F02D 2041/389* (2013.01); *F02D 2041/3881* (2013.01)

(58) Field of Classification Search

CPC .. F02D 41/38; F02D 41/3845; F02D 41/3881; F02D 41/389; F02D 41/2406; F02D 41/26; F02M 55/025; F02M 59/20

See application file for complete search history.

(56) References Cited

U.S. PATENT DOCUMENTS

| | | | | |
|---|---|---|---|---|
| 5,712,274 | A | 1/1998 | Sueoka et al. | |
| 5,839,412 | A | 11/1998 | Stockner et al. | |
| 6,345,606 | B1 | 2/2002 | Ricci-Ottati et al. | |
| 7,891,342 | B2 | 2/2011 | Dintino et al. | |
| 8,118,006 | B2 | 2/2012 | Pursifull | |
| 8,306,723 | B2 | 11/2012 | Haskara et al. | |
| 8,485,160 | B2 | 7/2013 | Li et al. | |
| 8,590,510 | B2 * | 11/2013 | Surnilla | F02M 39/02 123/431 |
| 8,776,764 | B2 * | 7/2014 | Basmaji | F02D 19/0605 123/27 GE |
| 9,453,476 | B2 * | 9/2016 | Rumpsa | F02M 63/0265 |
| 2009/0063018 | A1 | 3/2009 | Takeuchi et al. | |
| 2009/0320790 | A1 | 12/2009 | Lewis et al. | |

(Continued)

OTHER PUBLICATIONS

Sanborn, E. et al., "Method for Operating a Dual Fuel Injection System," U.S. Appl. No. 14/805,068, filed Jul. 21, 2015, 62 pages.

*Primary Examiner* — Hieu T Vo

(74) *Attorney, Agent, or Firm* — Julia Voutyras; John D. Russell; B. Anna McCoy

(57) ABSTRACT

A method of operating an engine with dual fuel injection capabilities to enable fuel rail over-pressure control is shown. The method comprises operating an engine cylinder with only port injection, while selectively activating and deactivating a direct injector in response to an estimated minimum fuel injection mass from the direct injector. Direct fuel injection is actuated until the minimum fuel mass injected by the direct injector has reached a lower threshold that is above an NVH limit of the engine.

20 Claims, 5 Drawing Sheets

(56) References Cited

U.S. PATENT DOCUMENTS

| | | | | |
|---|---|---|---|---|
| 2013/0046454 | A1 | 2/2013 | Cowgill et al. | |
| 2013/0218441 | A1 | 8/2013 | Thomas et al. | |
| 2014/0290597 | A1 | 10/2014 | Rumpsa et al. | |
| 2016/0169147 | A1 * | 6/2016 | Surnilla ..... | F02D 41/2467 123/299 |

* cited by examiner

METHOD FOR OPERATING A FUEL INJECTION SYSTEM

FIELD

The present description relates generally to methods and systems for controlling a dual fuel injection system coupled to an internal combustion engine.

BACKGROUND AND SUMMARY

Engines may be configured with various fuel systems for delivering a desired amount of fuel to a combustion chamber. Example fuel systems may include port fuel injectors for delivering fuel into an intake port upstream of a combustion chamber, and direct fuel injectors for delivering fuel directly into the combustion chamber. Still other engines may be configured with a dual fuel injection system that includes each of a port fuel injector and a direct fuel injector for each engine cylinder. The different fuel injection systems provide different advantages. For example, port fuel injectors may be operated to improve fuel vaporization and reduce engine emissions, as well as to reduce pumping losses at low loads. As another example, direct fuel injectors may be operated to improve engine performance and fuel consumption at higher loads. Dual fuel injection systems are able to leverage the advantages of both types of fuel delivery.

As such, there may be operating conditions where engines configured with dual fuel injection capabilities operate for an extended period with one of the injection systems inactive. For example, there may be conditions where the engine is operated with port injection only and the direct injectors are maintained inactive. The direct injectors may be coupled to a high-pressure fuel rail downstream of a high-pressure fuel pump. During the extended periods of non-operation of the direct injectors, the presence of a one-way check valve may result in high-pressure fuel being trapped in the high-pressure fuel rail. If the stagnating fuel is exposed to higher temperatures (such as higher ambient temperatures), the fuel may begin to expand and vaporize in the fuel rail, resulting in an increased fuel pressure, due to the closed and rigid nature of the fuel rail. This increased fuel temperature and pressure may in turn affect the durability of both the direct fuel injectors and related fuel hardware, in particular when the direct fuel injection system is enabled again. In addition, metering errors may occur when the direct fuel injector is re-enabled.

Example attempts to address direct fuel injector degradation due to stagnant fuel include activating a second injector in response to a fuel rail temperature increase. One example approach is shown by Rumpsa et al. in U.S. 2014/0290597. Therein, when operating an engine cylinder with fuel from a port fuel injector and not a direct injector, the direct injector is activated in response to a fuel temperature or pressure increase at a direct injection fuel rail. Fuel is then injected from the direct injector, while continuing to maintain engine combustion via port injection, until the fuel rail pressure and temperature is under control.

However, the inventors herein have recognized potential issues with such an approach. For example, as the pressure of fuel stagnating in the direct injection fuel rail increases, the minimum amount of fuel mass which is injected into the cylinder from the activated direct injector also increases. This can result in a larger than desired fuel mass being injected when the direct injection fuel system is re-enabled. As a result of the metering error, the engine may run at an air-fuel ratio that is richer than desired, increasing engine emissions, reducing engine stability, and degrading fuel economy. Additionally, there may be increased NVH issues. Still further, injecting a predetermined amount of fuel (e.g., injecting for a predetermined amount of time or directly injecting a predetermined fuel mass) may include injecting with a large proportion of direct injection to port fuel injection, thereby resulting in degraded engine performance.

In one example, the issues described above may be addressed by a method for an engine, comprising: while operating an engine cylinder with fuel from only a first injector, transiently opening a second injector to inject fuel into the cylinder; estimating a mass of the injected fuel mass based on a parameter of the injected fuel; and closing the second injector when the estimated mass is below a lower threshold, the lower threshold adjusted based on one or more engine operating conditions. In this way, fuel system hardware damage is averted.

As one example, during conditions when an engine is operated with port injection only, a direct injector may be intermittently activated and deactivated to maintain a minimum fuel injection mass of the direct injector within a desired range. Specifically, while maintaining a high-pressure fuel pump disabled, a minimum fuel injection mass from the direct injector may be estimated based on fuel parameters, specifically fuel temperature and pressure, of fuel in the direct injection fuel rail. As the temperature and/or pressure of fuel stagnating in the direct injection fuel rail increases, the minimum fuel injection mass may also increase. A cylinder direct injector may be selectively activated when the estimated minimum fuel injection mass reaches an upper threshold. Fuel may then be injected from the direct injectors until the minimum fuel injection mass reaches a lower threshold. Further, the lower threshold may be adjusted based on operating conditions while maintaining the lower threshold above a level where the high-pressure fuel pump needs to be re-enabled. For example, the lower threshold may be may be adjusted based on exhaust soot levels, engine knock or pre-ignition history, etc.

The technical effect of selectively opening and closing the direct fuel injectors based on a varying minimum fuel injection mass of the direct injector is that the direct injector may be able to inject small fuel masses when the direct injection system is re-enabled. In addition, hardware damage to the direct injection fuel system is reduced. By maintaining the minimum fuel injection mass within a desired range, fuel metering errors due to the injection of more fuel than commanded is reduced, specifically when smaller fuel injection amounts are commanded from the direct injector. In addition, the need to operate the high pressure fuel pump to deliver fuel via the direct injector is reduced. By prolonging a duration that the engine can operate with only port fuel injection and with the high pressure fuel pump disabled provides additional fuel economy benefits and reduces NVH issues.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically depicts an example embodiment of a cylinder of an internal combustion engine.

FIG. 2 schematically depicts an example embodiment of a fuel system coupled to an engine having dual fuel injection capabilities.

DETAILED DESCRIPTION

Figure 1:
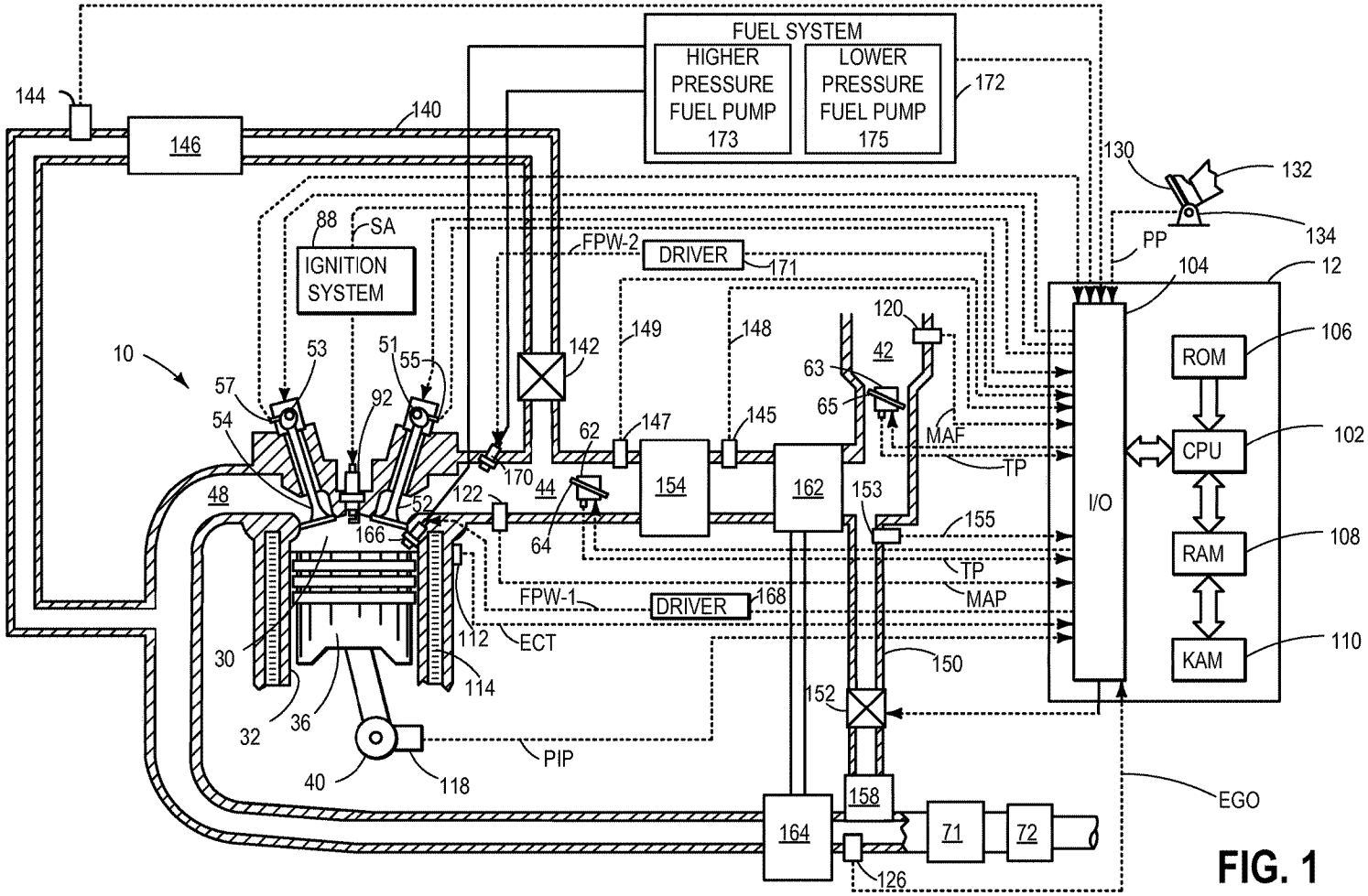
Figure 2:
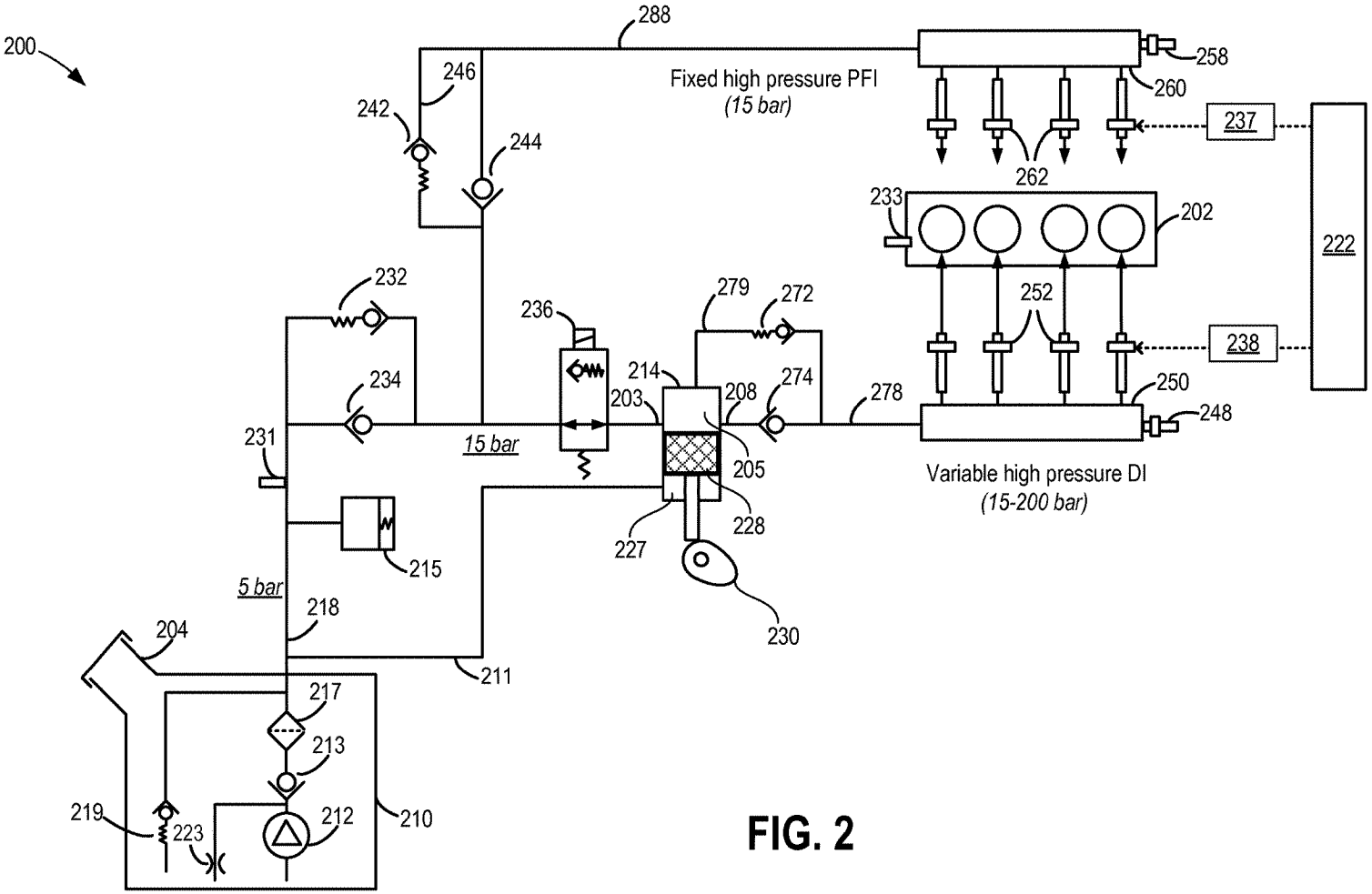
Figure 4:
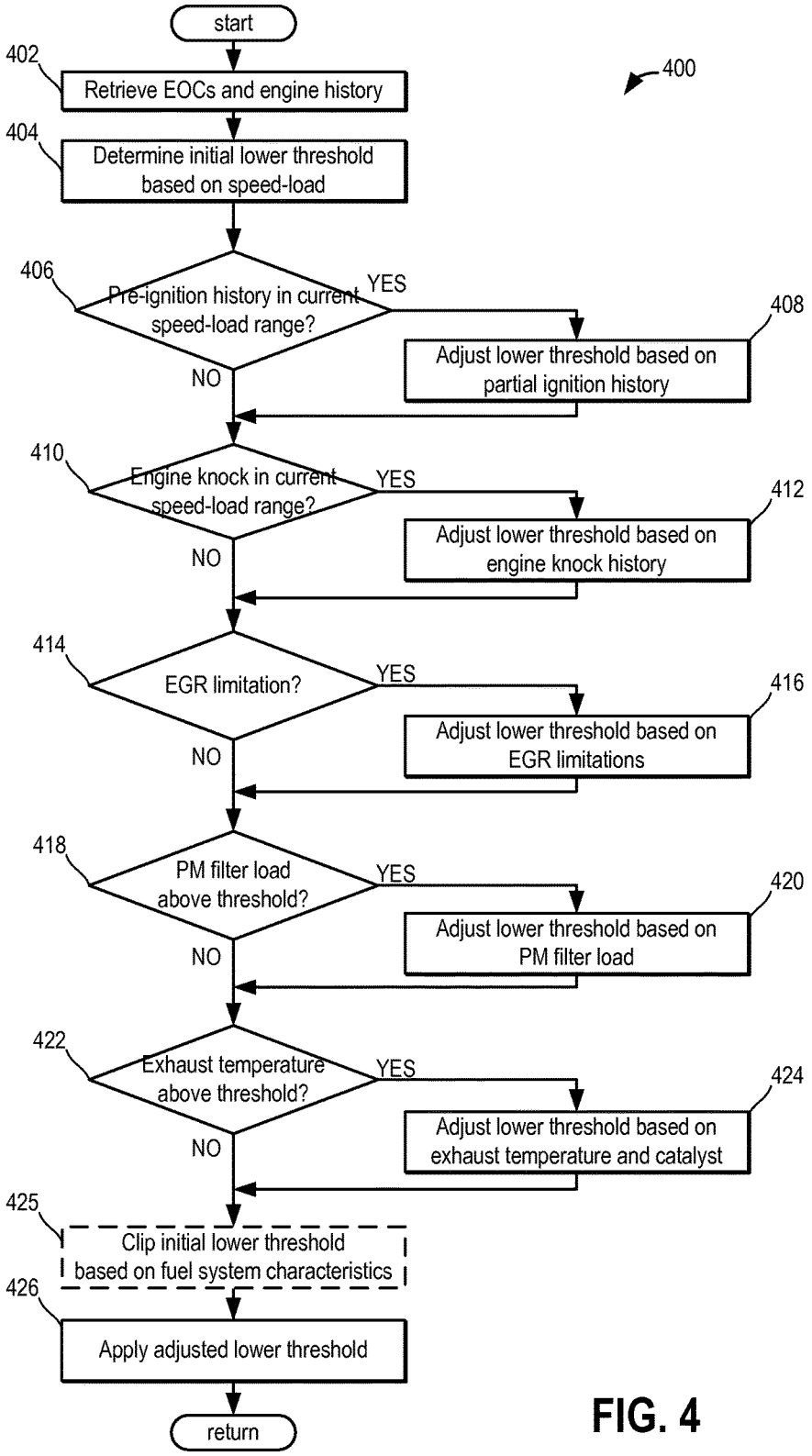
FIG. 4 depicts an example flow chart for adjusting a lower threshold of a fuel rail pressure at which a direct injector is selectively deactivated.
Figure 5:
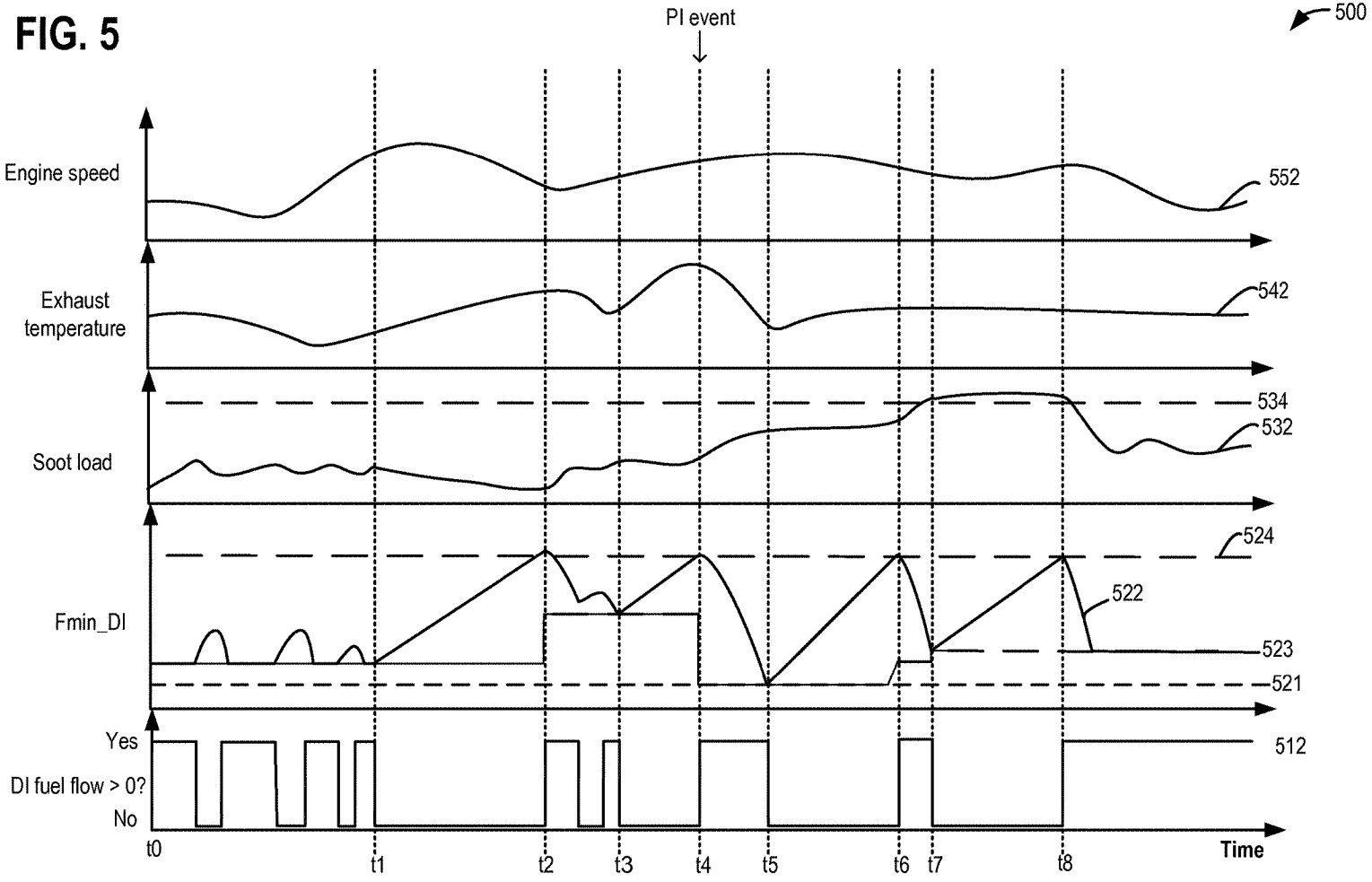
FIG. 5 shows a graphical representation of an example opening and closing of a direct-fuel injector to maintain a minimum fuel injection mass from the direct injector within a range, according to the present disclosure.

The present description relates to systems and methods for operating a direct fuel injector within an engine system configured with dual fuel injection capabilities. In one non-limiting example, the engine may be configured as illustrated in FIG. 1. Further, additional components of an associated fuel system is depicted at FIG. 2. An engine controller may be configured to perform a control routine, such as the example routine of FIG. 3 to selectively activate and deactivate the direct fuel injector during conditions when the engine is fueled via port injection only to maintain the minimum fuel injection mass from a direct injector within a desired range. Further, the upper and the lower threshold at which the direct injector is deactivated may be adjusted, for example in real-time, based on engine operating conditions (FIG. 4). Therein, initial thresholds are determined based on an engine speed-load condition, and adjusted based on engine operating parameters such as engine pre-ignition history, knock history, particulate filter soot load, exhaust temperature, and exhaust gas recirculation limitations. An example timeline for operating a direct fuel injector in accordance with the above methods and systems is depicted in FIG. 5.

Turning now to FIG. 1, it shows a schematic diagram of one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. In some embodiments, the face of piston 36 inside cylinder 30 may have a bowl. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via intake cam 51. Similarly, exhaust valve 54 may be controlled by controller 12 via exhaust cam 53. Alternatively, the variable valve actuator may be electric, electro hydraulic or any other conceivable mechanism to enable valve actuation. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

In some embodiments, each cylinder of engine 10 may be configured with one or more fuel injectors for providing fuel thereto. As a non-limiting example, cylinder 30 is shown including two fuel injectors 166 and 170. Fuel injector 166 is shown coupled directly to cylinder 30 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 30. Thus, fuel injector 166 is a direct fuel injector in communication with cylinder 30. While FIG. 1 shows injector 166 as a side injector, it may also be located overhead of the piston, such as near the position of spark plug 92. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from high pressure fuel system 172 including a fuel tank, fuel pumps, a fuel rail, and driver 168. Alternatively, fuel may be delivered by a single stage fuel pump at lower pressure, in which case the timing of the direct fuel injection may be more limited during the compression stroke than if a high pressure fuel system is used. Further, while not shown, the fuel tank may have a pressure transducer providing a signal to controller 12.

Fuel injector 170 is shown arranged in intake passage 42 (e.g., within intake manifold 44), rather than in cylinder 30, in a configuration that provides what is known as port injection of fuel (hereafter referred to as "PFI") into the intake port upstream of cylinder 30. From the intake port, the fuel may be delivered to cylinder 30. Thus, fuel injector 170 is a port fuel injector in communication with cylinder 30. Fuel injector 170 may inject fuel in proportion to the pulse width of signal FPW-2 received from controller 12 via electronic driver 171. Fuel may be delivered to fuel injector 170 by fuel system 172.

Fuel may be delivered by both injectors to the cylinder during a single cycle of the cylinder. For example, each injector may deliver a portion of a total fuel injection that is combusted in cylinder 30. Further, the distribution and/or relative amount of fuel delivered from each injector may vary with operating conditions such as described herein below. The relative distribution of the total injected fuel among injectors 166 and 170 may be referred to as a first injection ratio. For example, injecting a larger amount of the fuel for a combustion event via (port) injector 170 may be an example of a higher first ratio of port to direct injection, while injecting a larger amount of the fuel for a combustion event via (direct) injector 166 may be a lower first ratio of port to direct injection. Note that these are merely examples of different injection ratios, and various other injection ratios may be used. Additionally, it should be appreciated that port injected fuel may be delivered during an open intake valve event, closed intake valve event (e.g., substantially before an intake stroke, such as during an exhaust stroke), as well as during both open and closed intake valve operation. Similarly, directly injected fuel may be delivered during an intake stroke, as well as partly during a previous exhaust stroke, during the intake stroke, and partly during the compression stroke, for example. Further, the direct injected fuel may be delivered as a single injection or multiple injections. These may include multiple injections during the compression stroke, multiple injections during the intake stroke, or a combination of some direct injections during the compression stroke and some during the intake stroke. When multiple direct injections are performed, the relative distribution of the total directed injected fuel between an intake stroke (direct) injection and a compression stroke (direct) injection may be referred to as a second injection ratio. For example, injecting a larger amount of the direct injected fuel for a combustion event during an intake stroke may be an example of a higher second ratio of intake stroke direct injection, while injecting a larger amount of the fuel for a combustion event during a compression stroke may be an example of a lower second ratio of intake stroke direct injection. Note that these are merely examples of different injection ratios, and various other injection ratios may be used.

As such, even for a single combustion event, injected fuel may be injected at different timings from a port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel system 172 may include one fuel tank or multiple fuel tanks. In embodiments where fuel system 172 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 172 may include a fuel tank holding a liquid fuel, such as gasoline, and also include a fuel tank holding a gaseous fuel, such as CNG. Fuel injectors 166 and 170 may be configured to inject fuel from the same fuel tank, from different fuel tanks, from a plurality of the same fuel tanks, or from an overlapping set of fuel tanks. Fuel system 172 may include a lower pressure fuel pump 175 (such as a lift pump) and a higher pressure fuel pump 173. As detailed with reference to the fuel system of FIG. 2, the lower pressure fuel pump 175 may lift fuel from a fuel tank, the fuel then further pressurized by higher pressure fuel pump 173. In addition, lower pressure fuel pump 175 may provide fuel to a port injection fuel rail while higher pressure fuel pump 173 delivers fuel to a direct injection fuel rail.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake passage 42 may include throttles 62 and 63 having throttle plates 64 and 65, respectively. In this particular example, the positions of throttle plates 64 and 65 may be varied by controller 12 via signals provided to an electric motor or actuator included with throttles 62 and 63, a configuration that is commonly referred to as electronic throttle control (ETC). In this manner, throttles 62 and 63 may be operated to vary the intake air provided to combustion chamber 30 among other engine cylinders. The positions of throttle plates 64 and 65 may be provided to controller 12 by throttle position signals TP. Pressure, temperature, and mass air flow may be measured at various points along intake passage 42 and intake manifold 44. For example, intake passage 42 may include a mass air flow sensor 120 for measuring clean air mass flow entering through throttle 63. The clean air mass flow may be communicated to controller 12 via the MAF signal.

Engine 10 may further include a compression device such as a turbocharger or supercharger including at least a compressor 162 arranged upstream of intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A charge air cooler 154 may be included downstream from compressor 162 and upstream of intake valve 52. Charge air cooler 154 may be configured to cool gases that have been heated by compression via compressor 162, for example. In one embodiment, charge air cooler 154 may be upstream of throttle 62. Pressure, temperature, and mass air flow may be measured downstream of compressor 162, such as with sensor 145 or 147. The measured results may be communicated to controller 12 from sensors 145 and 147 via signals 148 and 149, respectively. Pressure and temperature may be measured upstream of compressor 162, such as with sensor 153, and communicated to controller 12 via signal 155.

Further, in the disclosed embodiments, an exhaust gas recirculation (EGR) system may route a desired portion of exhaust gas from exhaust passage 48 to intake manifold 44. FIG. 1 shows a high pressure EGR (HP-EGR) system and a low pressure EGR (LP-EGR) system, but an alternative embodiment may include only an LP-EGR system. The HP-EGR is routed through HP-EGR passage 140 from upstream of turbine 164 to downstream of compressor 162. The amount of HP-EGR provided to intake manifold 44 may be varied by controller 12 via HP-EGR valve 142. The LP-EGR is routed through LP-EGR passage 150 from downstream of turbine 164 to upstream of compressor 162. The amount of LP-EGR provided to intake manifold 44 may be varied by controller 12 via LP-EGR valve 152. The HP-EGR system may include HP-EGR cooler 146 and the LP-EGR system may include LP-EGR cooler 158 to reject heat from the EGR gases to engine coolant, for example. Thus, engine 10 may comprise both an HP-EGR and an LP-EGR system to route exhaust gases back to the intake.

Under some conditions, the EGR system may be used to regulate the temperature of the air and fuel mixture within combustion chamber 30. Thus, it may be desirable to measure or estimate the EGR mass flow. EGR sensors may be arranged within EGR passages and may provide an indication of one or more of mass flow, pressure, temperature, concentration of $O_2$, and concentration of the exhaust gas. For example, an HP-EGR sensor 144 may be arranged within HP-EGR passage 140.

In some embodiments, one or more sensors may be positioned within LP-EGR passage 150 to provide an indication of one or more of a pressure, temperature, and air-fuel ratio of exhaust gas recirculated through the LP-EGR passage. Exhaust gas diverted through LP-EGR passage 150 may be diluted with fresh intake air at a mixing point located at the junction of LP-EGR passage 150 and intake passage 42. Specifically, by adjusting LP-EGR valve 152 in coordination with first air intake throttle 63 (positioned in the air intake passage of the engine intake, upstream of the compressor), a dilution of the EGR flow may be adjusted.

A percent dilution of the LP-EGR flow may be inferred from the output of a sensor 145 in the engine intake gas stream. Specifically, sensor 145 may be positioned downstream of first intake throttle 63, downstream of LP-EGR valve 152, and upstream of second main intake throttle 62, such that the LP-EGR dilution at or close to the main intake throttle may be accurately determined. Sensor 145 may be, for example, an oxygen sensor such as a UEGO sensor.

Exhaust gas sensor 126 is shown coupled to exhaust passage 48 downstream of turbine 164. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor.

Emission control devices 71 and 72 are shown arranged along exhaust passage 48 downstream of exhaust gas sensor 126. Devices 71 and 72 may be a selective catalytic reduction (SCR) system, three way catalyst (TWC), $NO_x$ trap, various other emission control devices, or combinations thereof. For example, device 71 may be a TWC and device 72 may be a particulate filter (PF). In some embodiments, PF 72 may be located downstream of TWC 71 (as shown in FIG. 1), while in other embodiments, PF 72 may be positioned upstream of TWC 72 (not shown in FIG. 1). PF 72 may include a soot load sensor 198, which may communicate a particulate matter loading amount via signal PM to controller 12.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. The controller 12 receives signals from the various sensors of FIG. 1 (and those of FIG. 2 described below) and employs the various actuators of FIG. 1 (and those of FIG. 2 described below) to adjust engine operation based on the received signals and instructions stored on a memory of the controller.

Storage medium read-only memory 106 can be programmed with computer readable data representing instructions executable by processor 102 for performing the methods described below as well as other variants that are anticipated but not specifically listed. An example routine that may be performed by the controller is described at FIG. 3.

FIG. 2 schematically depicts an example embodiment 200 of a fuel system, such as fuel system 172 of FIG. 1. Fuel system 200 may be operated to deliver fuel to an engine, such as engine 10 of FIG. 1. Fuel system 200 may be operated by a controller to perform some or all of the operations described with reference to the process flows of FIG. 3.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Thus fuel rail 250 is in communication with a direct injector. Fuel lifted by the LPP 212 may also be supplied to a second fuel rail 260 coupled to one or more fuel injectors of a second group of port injectors 262 (herein also referred to as a second injector group). Thus fuel rail 260 is in communication with a port injector. As elaborated below, HPP 214 may be operated to raise the pressure of fuel delivered to each of the first and second fuel rail above the lift pump pressure, with the first fuel rail coupled to the direct injector group operating with a variable high pressure while the second fuel rail coupled to the port injector group operates with a fixed high pressure. Thus, high-pressure fuel pump 214 is in communication with each of fuel rail 260 and fuel rail 250. As a result, high pressure port and direct injection may be enabled. The high pressure fuel pump is coupled downstream of the low pressure lift pump with no additional pump positioned in between the high pressure fuel pump and the low pressure lift pump.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Fuel system 200 may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in fuel passage 218, as shown, or in a bypass passage 211 coupling fuel passage 218 to the step-room 227 of HPP 214. The volume of accumulator 215 may be sized such that the engine can operate at idle conditions for a predetermined period of time between operating intervals of lower pressure fuel pump 212. For example, accumulator 215 can be sized such that when the engine idles, it takes one or more minutes to deplete pressure in the accumulator to a level at which higher pressure fuel pump 214 is incapable of maintaining a sufficiently high fuel pressure for fuel injectors 252, 262. Accumulator 215 may thus enable an intermittent operation mode (or pulsed mode) of lower pressure fuel pump 212. By reducing the frequency of LPP operation, power consumption is reduced. In other embodiments, accumulator 215 may inherently exist in the compliance of fuel filter 217 and fuel passage 218, and thus may not exist as a distinct element.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212. While lift pump fuel pressure sensor 231 is shown as being positioned downstream of accumulator 215, in other embodiments the sensor may be positioned upstream of the accumulator.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. In comparison, second fuel rail 260 is coupled to an inlet 203 of HPP 214 via fuel passage 288. A check valve and a pressure relief valve may be positioned between the outlet 208 of the HPP 214 and the first fuel rail. In addition, pressure relief valve 272, arranged parallel to check valve 274 in bypass passage 279, may limit the pressure in fuel passage 278, located downstream of HPP 214 and upstream of first fuel rail 250. For example, pressure relief valve 272 may limit the pressure in fuel passage 278 to an upper threshold pressure (e.g., 200 bar). As such, pressure relief valve 272 may limit the pressure that would otherwise be generated in fuel passage 278 if control valve 236 were (intentionally or unintentionally) open and while high pressure fuel pump 214 were pumping.

One or more check valves and pressure relief valves may also be coupled to fuel passage 218, downstream of LPP 212 and upstream of HPP 214. For example, check valve 234 may be provided in fuel passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure to its left to 10 bar higher than the pressure at sensor 231.

Controller 222 may be configured to regulate fuel flow into HPP 214 through control valve 236 by energizing or de-energizing the solenoid valve (based on the solenoid valve configuration) in synchronism with the driving cam. Accordingly, the solenoid activated control valve 236 may be operated in a first mode where the valve 236 is positioned within HPP inlet 203 to limit (e.g. inhibit) the amount of fuel traveling through the solenoid activated control valve 236. Depending on the timing of the solenoid valve actuation, the volume transferred to the fuel rail 250 is varied. The solenoid valve may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the direct injection fuel pump. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Pressure relief valve 232 allows fuel flow out of solenoid activated control valve 236 toward the LPP 212 when pressure between pressure relief valve 232 and solenoid operated control valve 236 is greater than a predetermined pressure (e.g., 10 bar). When solenoid operated control valve 236 is deactivated (e.g., not electrically energized), solenoid operated control valve operates in a pass-through mode and pressure relief valve 232 regulates pressure in compression chamber 205 to the single pressure relief set-point of pressure relief valve 232 (e.g., 10 bar above the pressure at sensor 231). Regulating the pressure in compression chamber 205 allows a pressure differential to form from the piston top to the piston bottom. The pressure in step-room 227 is at the pressure of the outlet of the low pressure pump (e.g., 5 bar) while the pressure at piston top is at pressure relief valve regulation pressure (e.g., 15 bar). The pressure differential allows fuel to seep from the piston top to the piston bottom through the clearance between the piston and the pump cylinder wall, thereby lubricating HPP 214.

Piston 228 reciprocates up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

A forward flow outlet check valve 274 may be coupled downstream of an outlet 208 of the compression chamber 205. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. Thus, during conditions when direct injection fuel pump operation is not requested, controller 222 may deactivate solenoid activated control valve 236 and pressure relief valve 232 regulates pressure in compression chamber 205 to a single substantially constant pressure during most of the compression stroke. On the intake stroke the pressure in compression chamber 205 drops to a pressure near the pressure of the lift pump (212). Lubrication of DI pump 214 may occur when the pressure in compression chamber 205 exceeds the pressure in step-room 227. This difference in pressures may also contribute to pump lubrication when controller 222 deactivates solenoid activated control valve 236. One result of this regulation method is that the fuel rail is regulated to a minimum pressure, approximately the pressure relief of pressure relief valve 232. Thus, if pressure relief valve 232 has a pressure relief setting of 10 bar, the fuel rail pressure becomes 15 bar because this 10 bar adds to the 5 bar of lift pump pressure. Specifically, the fuel pressure in compression chamber 205 is regulated during the compression stroke of direct injection fuel pump 214. Thus, during at least the compression stroke of direct injection fuel pump 214, lubrication is provided to the pump. When direct fuel injection pump enters a suction stroke, fuel pressure in the compression chamber may be reduced while still some level of lubrication may be provided as long as the pressure differential remains. Another pressure relief valve 272 may be placed in parallel with check valve 274. Pressure relief valve 272 allows fuel flow out of the DI fuel rail 250 toward pump outlet 208 when the fuel rail pressure is greater than a predetermined upper threshold pressure. As such, while the direct injection fuel pump is reciprocating, the flow of fuel between the piston and bore ensures sufficient pump lubrication and cooling.

The lift pump may be transiently operated in a pulsed mode where the lift pump operation is adjusted based on a pressure estimated at the outlet of the lift pump and inlet of the high pressure pump. In particular, responsive to high pressure pump inlet pressure falling below a fuel vapor pressure, the lift pump may be operated until the inlet pressure is at or above the fuel vapor pressure. This reduces the risk of the high pressure fuel pump ingesting fuel vapors (instead of fuel) and ensuing engine stall events.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Solenoid activated control valve 236 may also be operated to direct fuel back-flow from the high pressure pump to one of pressure relief valve 232 and accumulator 215. For example, control valve 236 may be operated to generate and store fuel pressure in accumulator 215 for later use. One use of accumulator 215 is to absorb fuel volume flow that results from the opening of compression pressure relief valve 232. Accumulator 227 sources fuel as check valve 234 opens during the intake stroke of pump 214. Another use of accumulator 215 is to absorb/source the volume changes in the step room 227. Yet another use of accumulator 215 is to allow intermittent operation of lift pump 212 to gain an average pump input power reduction over continuous operation.

While the first direct injection fuel rail 250 is coupled to the outlet 208 of HPP 214 (and not to the inlet of HPP 214), second port injection fuel rail 260 is coupled to the inlet 203 of HPP 214 (and not to the outlet of HPP 214). Although inlets, outlets, and the like relative to compression chamber 205 are described herein, it may be appreciated that there may be a single conduit into compression chamber 205. The single conduit may serve as inlet and outlet. In particular, second fuel rail 260 is coupled to HPP inlet 203 at a location upstream of solenoid activated control valve 236 and downstream of check valve 234 and pressure relief valve 232. Further, no additional pump may be required between lift pump 212 and the port injection fuel rail 260. As elaborated below, the specific configuration of the fuel system with the port injection fuel rail coupled to the inlet of the high pressure pump via a pressure relief valve and a check valve enables the pressure at the second fuel rail to be raised via the high pressure pump to a fixed default pressure that is above the default pressure of the lift pump. That is, the fixed high pressure at the port injection fuel rail is derived from the high pressure piston pump.

When the high pressure pump 214 is not reciprocating, such as at key-up before cranking, check valve 244 allows the second fuel rail to fill at 5 bar. As the pump chamber displacement becomes smaller due to the piston moving upward, the fuel flows in one of two directions. If the spill valve 236 is closed, the fuel goes into the high pressure fuel rail 250 via high pressure fuel pump outlet 208. If the spill valve 236 is open, the fuel goes either into the low pressure fuel rail 250 or through the compression relief valve 232 via high pressure fuel pump inlet 203. In this way, the high pressure fuel pump is operated to deliver fuel at a variable high pressure (such as between 15-200 bar) to the direct fuel injectors 252 via the first fuel rail 250 while also delivering fuel at a fixed high pressure (such as at 15 bar) to the port fuel injectors 262 via the second fuel rail 260. The variable pressure may include a minimum pressure that is at the fixed pressure.

Thus spill valve 236 may be operated to control a bulk fuel flow from the high pressure fuel pump outlet to DI fuel rail 250 to be substantially equal to zero, and to control a bulk fuel flow from the high pressure fuel pump inlet to PFI fuel rail 260. As one example, when one or more direct injectors 252 are deactivated, spill valve 236 may be operated to control the bulk fuel flow from HPP outlet 208 to DI fuel rail 250 to be substantially equal to zero. Additionally, the bulk fuel flow from HPP outlet 208 to DI fuel rail 250 may be controlled to be substantially equal to zero if direct injectors 252 are activated while pressure within DI fuel rail 250 is above a minimum pressure threshold (e.g., 15 bar). In both conditions, bulk fuel flow form HPP inlet 203 to PFI fuel rail 260 may be controlled to be substantially greater than zero. When fuel flow to one of fuel rails 250 or 260 is controlled to be substantially equal to zero, fuel flow thereto may be herein be referred to as disabled.

In the configuration depicted at FIG. 2, the fixed pressure of the port injection fuel rail is the same as the minimum pressure for the direct injection fuel rail, both being higher than the default pressure of the lift pump. Herein, the fuel delivery from the high pressure pump is controlled via the upstream (solenoid activated) control valve and further via the various check valve and pressure relief valves coupled to the inlet of the high pressure pump. By adjusting operation of the solenoid activated control valve, the fuel pressure at the first fuel rail is raised from the fixed pressure to the variable pressure while maintaining the fixed pressure at the second fuel rail. Valves 244 and 242 work in conjunction to keep the low pressure fuel rail 260 pressurized to 15 bar during the pump inlet stroke. Pressure relief valve 242 simply limits the pressure that can build in fuel rail 250 due to thermal expansion of fuel. A typical pressure relief setting may be 20 bar.

Controller 222 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed) of the low pressure pump. In some examples, the solenoid valve may be configured such that high pressure fuel pump 214 delivers fuel only to first fuel rail 250, and in such a configuration, second fuel rail 260 may be supplied fuel at the lower outlet pressure of lift pump 212.

Controller 222 can control the operation of each of injector groups 252 and 262. For example, controller 222 may control the distribution and/or relative amount of fuel delivered from each injector may vary with operating conditions, such as engine load, knock, and exhaust temperature. Specifically, controller 222 may adjust a direct injection fuel ratio by sending appropriate signals to port fuel injection driver 237 and direct injection 238, which may in turn actuate the respective port fuel injectors 262 and direct injectors 252 with desired pulse-widths for achieving the desired injection ratios. Additionally, controller 222 may selectively enable and disable (i.e., activate or deactivate) one or more of the injector groups based on fuel pressure within each rail. For example, based on a signal from first fuel rail pressure sensor 248, controller 222 may selectively activate second injector group 262 while controlling first injector group 252 in a deactivated state via respective injector drivers 237 and 238.

During some conditions, fuel pressure downstream of high pressure fuel pump 214 (e.g., within first fuel rail 250) may increase to an upper threshold pressure while fuel injectors 252 are deactivated. As one example, the fuel injectors may be operated to inject via only PFI (e.g., via injectors 262) based on engine operating conditions, and thus fuel injectors 252 may be deactivated during this time. While delivering fuel to the engine via only PFI, an increase in fuel rail temperature may occur due to high pressure fuel stagnating the DI fuel rail along with a rise in ambient temperature. A result of the increase in fuel rail temperature at the DI fuel rail is a corresponding increase in DI fuel rail pressure towards (or to) the upper threshold pressure. In addition, check valve 272 may maintain DI fuel rail 250 at the upper threshold pressure. However, the DI fuel rail pressure remaining at the upper threshold pressure for an extended duration may result in direct injector and/or DI fuel rail degradation. In addition, the increase in fuel rail temperature and pressure results in a minimum mass of fuel injected from the direct injector to be increased. This causes fuel metering errors, with the engine running richer than desired when the DI fuel system is re-enabled. The rich operation can affect engine fuel economy, exhaust emissions, as well as engine combustion stability.

Thus, DI fuel rail temperature or pressure may be monitored to estimate the minimum fuel injection mass from the direct injector. If the estimated mass rises to an upper threshold, it may be desirable to reduce the minimum injection mass by transiently opening the direct injector, thereby allowing the injection mass to fall. Further, if the estimated mass drops to a lower threshold, it may be desirable to raise the minimum injection mass by closing the direct injector, thereby allowing the injection mass to rise. In addition, since direct injection may not be desirable during conditions wherein fuel is injected via port injection only, one or more of upper and lower thresholds for the DI minimum fuel injection mass may be adjusted based on a number of engine operating conditions, thereby adjusting the amount of fuel delivered via DI.

Figure 3:
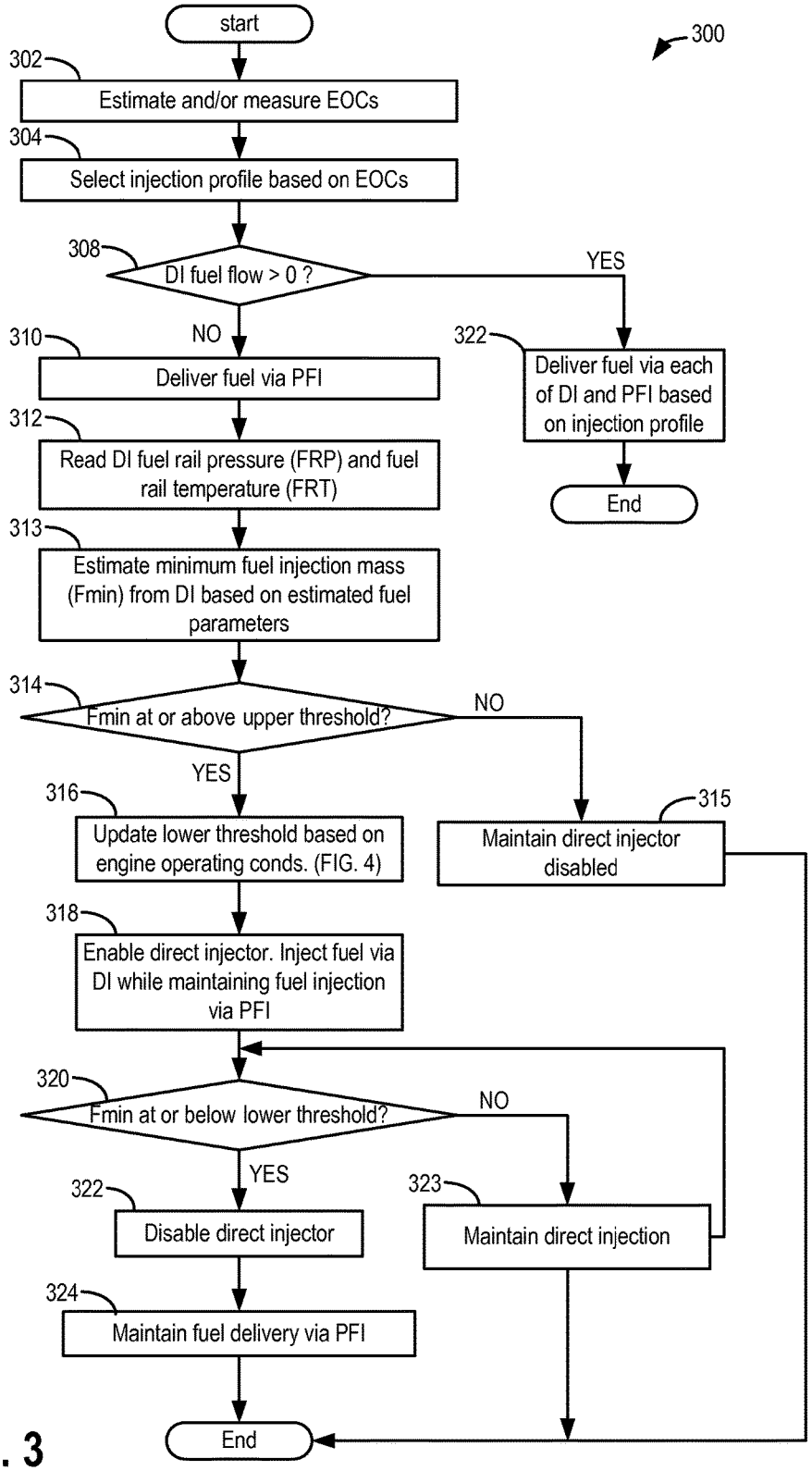
FIG. 3 depicts an example high level flow chart for operating an internal combustion engine including a port-fuel injection system and a direct-fuel injection system according to the present disclosure.

FIG. 3 shows an example method 300 for operating an engine configured with dual fuel injection capabilities, such as internal combustion engine 10 of FIG. 1 configured with fuel system 200 of FIG. 2. Specifically, method 300 enables the selective opening of a direct injector, during engine operation via port injection, responsive to changes in fuel temperature and pressure at a direct injection fuel rail that affect the minimum injection mass of fuel delivered by the direct injector. The method allows for improved fuel metering from the direct injector when it is enabled. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, method 300 may begin by measuring and/or estimating engine (and vehicle) operating conditions (EOCs). Estimating and/or measuring vehicle and engine operating conditions may include, for example, estimating and/or measuring engine temperature, ambient conditions (ambient temperature, pressure, humidity, etc.), torque demand, manifold pressure, manifold air flow, exhaust temperature, particulate filter load, fuel vapor canister load, exhaust catalyst conditions, oil temperature, oil pressure, etc. Estimating and/or measuring vehicle and engine operating conditions may include receiving signals from a plurality of sensors, such as the sensors at FIGS. 1-2, and processing these signals in an appropriate manner at an engine controller (e.g., controller 12 at FIG. 1).

At 304, method 300 may include selecting a fuel injection profile based on the engine operating conditions determined at 302. For example, the fuel injection profile may include details regarding an amount of fuel to be delivered, a timing of fuel injection, a number of injections for a given cylinder combustion event, as well as a ratio of fuel to be delivered via port relative to direct injection for each combustion event. It will be appreciated that in some examples, if an injection profile indicates delivering fuel via only port fuel injection (PFI), the direct injectors of the fuel system may be deactivated while the port injectors are maintained activated. Similarly, if an injection profile includes instructions to deliver fuel via only direct injection (DI), the port injectors of the fuel system may be deactivated while the direct injectors are maintained activated.

Continuing now to 308, it may be determined whether the fuel injection profile selected at 304 includes a DI fuel flow (or fuel mass) greater than 0. That is to say, it may be determined whether the fuel injection profile includes delivering at least some fuel via direct injection. If it is determined that DI fuel flow is greater than zero, routine 300 proceeds to 322, where fuel is delivered via each of direct injection and port injection according to the injection profile determined at 304. After 322, routine 300 terminates.

If it is determined that DI fuel flow is zero, routine 300 proceeds to 310, where fuel is delivered to the engine via only PFI according to the selected fuel injection profile. As a result, at 310, the method includes operating an engine cylinder with fuel from only a first, port injector while holding a second, direct injector closed. While fuel is delivered to the engine via only port fuel injection, the direct injectors may be deactivated. In addition, a high pressure fuel pump may be disabled.

As a result of the deactivation of the direct injectors, fuel may stagnate in the high pressure direct injection fuel rail. Consequently, the fuel within the DI fuel rail may be subject to pressure variations as a result of any temperature fluctuations within the DI fuel rail. For example, due to a rise in ambient temperature levels, the pressure of fuel in the DI fuel rail may rise.

At 312, method 300 may include reading the pressure (FRP) of fuel in the direct injection fuel rail. For example, with reference to FIG. 2, controller 222 may assess the fuel pressure in fuel rail 250 via a signal received from pressure sensor 248. The method also includes reading the temperature (FRT) of fuel in the direct injection fuel rail. For example, the controller may assess the fuel temperature in the direct injection fuel rail via a signal received from temperature sensor.

At 313, the method includes estimating a minimum fuel injection mass (Fmin) of the direct injector based on a fuel parameter of fuel in the DI fuel rail. The fuel parameter may include one or more of the measured fuel rail pressure and temperature. As such, the minimum fuel injection mass of the direct injector represents the minimum amount of fuel that can be injected by the direct injector, such as when the direct injector is operating with a minimum pulse-width. However, this minimum fuel injection mass is affected by the pressure (and therefore the temperature) of fuel in the fuel rail. Specifically, as the fuel rail pressure (or temperature) increases, the minimum fuel injection mass also increases. As such, this can result in the engine running richer than desired when the direct injector is enabled and fuel is delivered via direct injection.

At 314, the method includes comparing the calculated minimum fuel injection mass to an upper threshold and determining if Fmin is at or above the upper threshold. As such, above the upper threshold, the fuel injection mass delivered by the direct injector may be high enough to cause fuel metering errors. In one example, the upper threshold is based on a mass of fuel which comprises a defined smaller percentage of the total fuel. As such, the controller may avoid quickly transitioning between the fuel systems to reduce potential torque disturbances. As one example, with reference to fuel system 200, the upper threshold pressure may be the threshold pressure at which check valve 272 allows fuel to flow from fuel passage 278 to a location upstream of HPP 214. As another example, the upper threshold pressure may be based on each of fuel rigidity and a coefficient of thermal expansion of the fuel rail. If Fmin is determined to not be above the upper threshold, then at 315, the method includes maintaining the direct injector disabled (or closed).

If Fmin is determined to be at or above the upper threshold pressure, at 316, the method includes determining and/or updating a lower threshold to which the direct injection minimum fuel injection may be reduced. As described with reference to FIG. 4, the lower threshold may be adjusted, for example in real-time, based on engine limitations, such as particulate matter limitations, abnormal combustion event limitations, EGR limitation, etc.

After determining the lower threshold, the method proceeds to 318 wherein in response to the elevated minimum fuel injection mass, a cylinder direct injector may be transiently activated to enable direct injection of fuel into the cylinder. As such, since the minimum fuel injection mass is a function of fuel rail pressure and temperature, in alternate examples, the direct injector may be transiently opened in response to a fuel pressure, or fuel temperature, increase at a direct injection fuel rail. The direct injector may then be maintained open until the minimum fuel injection mass reaches the determined lower threshold. It will be appreciated that activating the direct injector includes maintaining delivery of at least some fuel to the engine via PFI. In addition, activating the direct injector may include adjusting injection of fuel from the port injector responsive to fuel injected by the direct injector. The ratio of direct injection fuel mass to port injection fuel mass for each cylinder combustion event may be determined based on one or more of the lower fuel rail pressure threshold, engine speed, engine load, engine temperature, exhaust temperature, soot load, spark timing, valve timing, etc. It will be further appreciated that injecting the predetermined fuel injection mass may occur across a number of injection events to maintain a desired air-fuel ratio. Additionally, activating the direct injector may include not delivering fuel to the direct injection fuel rail via the high pressure fuel pump. In this way, pressurization of the DI fuel rail via the high pressure fuel pump may be avoided while reducing the DI fuel pressure via transient direct injection.

In some examples, in addition to transiently opening the direct injector, a parameter of coolant flow may be adjusted (e.g., increased) in response to the pressure or temperature increase at the direct injection fuel rail. The parameter of coolant flow may be one or more of the flow rate of coolant, the temperature of coolant, the source of coolant, etc.

In the depicted example, transiently and selectively activating the direct injector includes injecting an amount of fuel via the direct injector, monitoring the fuel rail pressure and temperature to continually estimate a minimum fuel injection mass, and continuing direct injection until Fmin is at the lower threshold pressure. However, it will be appreciated that in other examples, the direct injector may be opened in response to a change in fuel rail pressure and temperature, and may remain activated for a predetermined amount of time, or to inject a predetermined amount of fuel there-through.

At 320, the method includes determining if Fmin has reached or dropped below the lower threshold. If not, then at 323 the method includes maintaining the direct injector enabled and continuing to direct inject fuel from the direct injection fuel rail into the cylinder. If Fmin has reached or dropped below the lower threshold, at 322, the direct injector may be deactivated. In an alternate example, since Fmin is determined as a function of fuel rail pressure and temperature, the direct injector may be deactivated in response to a fuel pressure decrease at the DI fuel rail. Additionally, the direct injector may remain deactivated until a change in the fuel injection profile requires the direct injector to be re-enabled. While the direct injector is deactivated, at 324, fuel delivery to the engine cylinders via the port injectors may be maintained, at least until a change in the fuel injection profile requires the port injector to be disabled.

In this way, while operating an engine cylinder with fuel from only a port injector, a direct injector may be transiently opened to inject fuel into the cylinder. A mass of the injected fuel is the estimated based on a parameter of the injected fuel, such as based on fuel temperature and/or pressure. The direct injector may then be selectively closed when the estimated mass is below a lower threshold.

One example method for adjusting the lower threshold at which the direct injector is disabled is shown at routine 400 of FIG. 4. In one example, the lower threshold may include determining a mass of fuel to deliver to the engine via direct injection during conditions where only port injection is requested/commanded, while maintaining the fuel injection mass above a mass at which the high pressure fuel pump has to be enabled. The lower threshold may be based on a desired fuel rail pressure. Consequently, the direct injected fuel is injected until the fuel rail pressure is at some calibratable offset above the desired fuel rail pressure. The desired fuel rail pressure, in turn, is based on engine speed and load.

As another example, determining the lower threshold may include determining a minimum desired direct injection mass. For example, if a vehicle controller anticipates that large direct injection masses may be desirable when direct injection is re-enabled (e.g., based on engine speed-load conditions), the lower threshold may be set higher to ensure that a desired injection mass may be achieved. As another example, if a vehicle controller anticipates that smaller direct injection masses are desirable when direct injection is re-enabled, the lower threshold may be lowered so that a minimum injection mass corresponding to a minimum injection pulse-width may be achieved.

Turning now to FIG. 4, routine 400 begins at 402 where engine operating conditions and engine history may be retrieved from memory (e.g., ROM 106 of controller 12 at FIG. 1) and/or measured. As one example, at 402 the engine controller may retrieve current speed-load conditions, pre-ignition history (e.g., an engine pre-ignition count), engine knock history (e.g., an engine knock count), EGR conditions, a current particulate matter load, one or more current exhaust temperatures (e.g., from one or more of exhaust sensors 126 and 144 at FIG. 1), exhaust catalyst conditions, and a history of lower fuel rail pressure thresholds previously applied. Additionally, if a current value for one or more of the aforementioned parameters is not available in memory, said parameters may be measured at 402.

At 404, an initial lower threshold fuel for minimum fuel injection mass from the direct injector may be determined based on an engine speed-load map. For example, the engine speed and engine load values estimated at 402 may be used in combination with a speed-load map stored in the controller's memory that may map a coordinate in speed-load space to a desired amount of directly injected fuel. As one example, the lower threshold increases with increased engine speed, and increases with increased engine load. This desired amount of directly injected fuel may correlate to a difference between the minimum fuel injection mass at the current fuel rail pressure and a desired minimum fuel injection mass at a lower fuel rail pressure.

In some examples, determining the lower threshold at 404 may include adjusting a previously determined lower threshold (e.g., the lower threshold value retrieved from memory at 402, as determined during a preceding execution of routine 400) toward the value determined via the speed-load map during the current execution of routine 400. For example, the lower threshold pressure determined at 404 may be filtered into the previous lower threshold value via a regression technique. In this way, the lower threshold value may be steadier across time.

Continuing now to 406, a pre-ignition history of the engine is retrieved, including for example, an engine pre-ignition count representing a number of pre-ignition events that have occurred in the engine over a drive cycle. If the engine pre-ignition count is higher than a threshold, it may be determined that the engine (or specific cylinders therein) is prone to pre-ignition. Accordingly, it may be desirable to increase the amount of directly injected fuel to reduce the likelihood of future pre-ignition events. If it is determined that the pre-ignition count of the engine is higher than the threshold, routine 400 proceeds to 408. Otherwise, routine 400 proceeds to 410.

At 408, the lower threshold may be adjusted, in response to the engine pre-ignition count. In one example, the lower threshold may be increased as the pre-ignition count increases. In another example, the lower threshold may be decreased as the pre-ignition count increases. As a result, the amount of fuel that is directly injected in response to a rise in the direct injection fuel rail pressure is varied. In this way, fuel injector degradation may be reduced while reducing the likelihood of a pre-ignition event. After 408, routine 400 proceeds to 410.

At 410, the engine knock history is retrieved and it is determined whether an engine knock count is higher than a threshold. For example, it may be determined if the engine history includes knock events at the current speed-load conditions. Additionally, current engine operating conditions may be used to predict whether knock may occur upon injecting fuel into the combustion chamber. For example, under conditions where exhaust temperature may become elevated, an engine (or a cylinder thereof) may become prone to engine knock events. If a threshold number of knock events have elapsed, and the engine knock count is higher than a threshold, it may be desirable to increase the amount of directly injected fuel to reduce the likelihood of further engine knock events. If it is determined that the engine knock count is higher than a threshold, routine 400 proceeds to 412. Otherwise, routine 400 proceeds to 414.

At 412, the lower threshold may be increased in response to operating at engine speed-load conditions that are prone to knock events. Consequently, the amount of fuel that is directly injected in response to a rise in direct injection fuel rail pressure is decreased. In this way, fuel injector degradation may be reduced while maintaining a larger amount of fuel in the DI fuel rail to inject in response to future engine knock events. Thus, by increasing the lower fuel rail pressure threshold in response to engine speed-load conditions that are prone to knock events, engine performance may be increased. After 412, routine 400 proceeds to 414.

At 414, it may be determined if there are any EGR limitations. For example, during low speed and medium load conditions, cooled-EGR may be limited. As another example, there may be a delay in attaining the desired amount of cooled-EGR. Herein, the cooled-EGR limitation may be addressed by adjusting the lower threshold. If adjusting the lower threshold is desired based on EGR conditions, routine 400 may proceed to 416. Otherwise, routine 400 proceeds to 418.

At 416, the lower threshold may be adjusted to a lower value in response to an EGR limitation. As a result, the amount of fuel that is directly injected in response to a direct injection fuel rail pressure/minimum injection mass reaching an upper threshold may be increased. As another example the lower threshold may be adjusted to a higher value in response to an EGR limitation. As a result, the amount of fuel that is directly injected in response to a direct injection fuel rail pressure/minimum injection mass reaching an upper threshold may be decreased. In this way, fuel injector degradation may be reduced while further cooling recirculated exhaust gas, thereby increasing engine performance. Alternatively at 416, in response to the cold-EGR limitation, the number of combustion events for which the direct injectors are activated may be increased or decreased while not adjusting the lower threshold. In this way, EGR may be provided across a desired number of combustion events. After 416, routine 400 proceeds to 418.

Continuing now to 418, it is determined whether the load of an exhaust particulate matter (PM) filter (e.g., emission control device 72 at FIG. 1) is above a threshold load. It will be appreciated that a PM filter load may herein also be referred to as a soot load. As one example, delivering fuel to the engine via direct injection may result in increased amounts of unburned fuel, particularly during high speed and/or high engine load conditions, thereby increasing soot emissions. If the soot load of the PM filter is at or above a threshold load, the increased soot emissions may not be adequately captured by the filter and thus may be introduced to the atmosphere. Thus, during conditions wherein the soot load is above the threshold load, direct injection may be less desirable due to higher PM emissions during direct injection. If the soot load is above the threshold load, routine 400 may proceed to 420 to adjust the lower threshold based on soot load. Otherwise routine 400 may proceed to 422.

At 420, the lower threshold may be adjusted based on the soot load of the PM filter. For example, the lower threshold may be increased in response to the soot load being above the threshold value. Consequently, the amount of fuel that is directly injected in response to a rise in direct injection fuel rail pressure is reduced. In another example, during high speed and/or high engine load conditions the lower fuel rail pressure threshold may be adjusted based on soot load whether or not the soot load is above the threshold load. In this example, as soot load increases, the adjusted lower threshold may increase, thereby providing less fuel via direct injection during higher soot load conditions. In this way, fuel injector degradation may be reduced while reducing soot emissions. After 420, routine 400 proceeds to 422.

At 422, exhaust temperature is compared to a threshold exhaust temperature. Specifically, at high load and high speed conditions, exhaust temperatures may be elevated. In one example, exhaust temperature (e.g., as measured by an exhaust temperature sensor) may be compared to a first threshold exhaust temperature. The first threshold exhaust temperature may be an upper threshold above which catalyst performance may degrade (e.g., the catalyst within TWC 71 at FIG. 1). Thus, the first threshold exhaust temperature may be based on a catalyst type and configuration. In another example, a temperature of exhaust recirculated via the HP-EGR loop (e.g., as measured by EGR sensor 144) may be compared to a second threshold exhaust temperature. The second threshold exhaust temperature may be an upper threshold above which degradation of turbine performance may occur (e.g., turbine 164 at FIG. 1). If one or more exhaust temperatures is above a threshold exhaust temperature, routine 400 proceeds to 424. Otherwise, routine 400 proceeds to 425.

At 424, the lower threshold may be adjusted based on one or more of the exhaust temperatures described above with regard to 422. For example, the lower threshold may be decreased in response to an exhaust temperature above a corresponding threshold temperature. As a result, the amount of fuel that is directly injected in response to a rise in direct injection fuel rail pressure is increased. Thus, to curb highly elevated exhaust temperatures, the lower threshold may be adjusted to the lower value (therefore the direct injection amount associated with the lower threshold may be increased to a higher value). In the case of a boosted engine, reduction of exhaust temperatures may also help to reduce a turbine inlet temperature, thereby reducing turbocharger durability issues. As such, delivering more fuel via direct injection may lead to a temporary drop in volumetric fuel economy, however, that may be accepted in view of the DI fuel rail pressure limitations and the exhaust temperature limitations. After 424, routine 400 proceeds to 425.

In some examples, the adjusted lower threshold determined at 422 and/or 424 may optionally be adjusted based on characteristics of the fuel system. As one example, a lower bound may be placed on the lower threshold, said lower bound based on the pressure or minimum fuel injection amount at which the high pressure pump must be reactivated. Thus, the lower bound may be a pressure below which the high pressure fuel pump must be enable for direct injections. With reference to fuel system 200 at FIG. 2, this lower bound may be based on the outlet pressure of high pressure fuel pump 214, in addition to the characteristics of direct injectors 252.

After one of 422 or 424, if the lower threshold is less than this lower bound, the threshold pressure may be clipped to the lower bound at 425. In another example, the threshold may be adjusted to be at least a predetermined amount of pressure above this lower bound. By adjusting the lower threshold, reactivation of the high pressure fuel pump may be avoided in the event of a fueling error during the lowering of the fuel pressure within the DI fuel rail.

At 426, the adjusted lower threshold may be applied in a higher-order injector control routine (e.g., routine 300 at FIG. 3). It will be appreciated that applying the lower threshold may further include storing the adjusted lower threshold in the controller's memory for a later adaptation. As an example, during a subsequent execution of routine 400, the adjusted lower threshold may be retrieved from memory at 402 and may be used for further adaptation. After 426, routine 400 may end.

Map 500 of FIG. 5 depicts a timeline for engine operation and for the operation of a direct fuel injector to maintain a minimum fuel injection mass from a deactivated direct injector within a desired range. This reduces fueling errors when the direct injector is re-enabled. As such, the minimum fuel injection mass is estimated based on fuel rail pressure and temperature at a direct injection fuel rail. Map 500 depicts the status of fuel flow through a direct injector at plot 512. Herein, when the direct injector is open, fuel may flow (fuel flow >0?=Yes) from a DI fuel rail into an engine cylinder, while when the direct injector is closed, there may be no fuel flow (fuel flow >0?=No). It will be appreciated that for the entire duration of the direct injector adaptation shown at FIG. 5, the engine is fueled via port injection.

Map 500 further depicts a minimum fuel injection mass at trace 522 in relation to an upper injection mass threshold (shown by line 524), and a lower injection mass threshold (shown by line 523). An exhaust particulate filter soot load is shown by trace 532, in relation an upper soot threshold (shown by line 534). As elaborated herein, soot load may be an example engine parameter used to adjust lower injection mass threshold 523. Exhaust temperature is shown at trace 542, and engine speed is shown at trace 552.

Vertical markers t0-t12 represent times of interest during the operating sequence. Herein, the direct injector is intermittently activated. Specifically, the direct injector is activated and fuel is injected during intervals spanning from times t0-t1, t2-t3, t5-t6, t7-t8, t10-t11, and t12 onward and the direct injector is deactivated during the intervals spanning from times t1-t2, t3-t5, t6-t7, t8-t10, and t11-t12. Thus, during the intervals spanning from times t1-t2, t3-t5, t6-t7, t8-t10, and t11-t12, the engine cylinder may be operated with only port fuel injection while during other times, the engine cylinder is operate with port and direct fuel injection.

At t0, the engine may be fueled with each of direct and port injection. While not depicted, the fuel flow rate may vary based on operating conditions. Between t0 and t1, the DI injector is intermittently disabled (where fuel flow is not greater than 0). During these periods, due to ambient conditions, a temperature and pressure of fuel stagnating in the DI fuel rail may increase. As a result, a minimum fuel injection mass from the direct injector may also correspondingly increase. During conditions wherein there is fuel flow from the direct injector, DI fuel rail pressure may decrease, with a corresponding decrease in the minimum fuel injection mass. Also between time t0 and t1, lower injection mass threshold 523 may be above a level 521 at which a high pressure fuel pump must be enabled before subsequent direct injection is allowed.

At t1, direct fuel injection is deactivated, for example, due to engine conditions where a fuel injection profile is selected that includes only port injected fuel. From t1 to t2, there is no fuel flow through the direct injector. The stagnating fuel may incur a rise in pressure, and thereby a rise in Fmin. As one example, due to the rigid nature of the fuel rail, Fmin may increase with fuel rail pressure and temperature.

At time t2, Fmin reaches upper threshold 524, responsive to which, DI fuel flow is commanded. Specifically, the direct injector is transiently activated in response to the increase in minimum fuel injection mass and direct injection is initiated. Additionally at t2, lower threshold 523 is raised based on engine speed-load conditions.

Between t2 and t3, fuel is delivered to a combustion cylinder via direct injection and port injection. As one example, the duration between t2 and t3 may comprise a single intake stroke or compression stroke direct injection event within a single cylinder combustion event, in addition to a single intake stroke port injection event. With the injection of fuel via the direct injector, a DI fuel rail pressure may drop with a corresponding drop in Fmin.

At t3, Fmin is decreased to lower threshold 523, responsive to which the direct injector is deactivated. Thus the transient activation of the direct injector responsive to a rise in Fmin to upper threshold 524 at t2 is ended via the deactivation of the direct injector responsive to a drop in Fmin to lower threshold 523 at t3. It will be appreciated that fuel flow through the port injector, and from a fuel pump (e.g., a high pressure fuel pump inlet) to a fuel rail coupled to the port injector, may each remain substantially greater than zero at t3.

From time t3 to time t5, DI fuel flow is equal to 0. Thus fuel may stagnate in the DI fuel rail. This may cause another increase in the DI fuel rail pressure, and thereby in Fmin of the direct fuel injector. At time t4, a pre-ignition (PI) event may occur, responsive to which lower threshold 523 is decreased.

Also at t4, Fmin again reaches upper threshold 524 in response to a rise in DI fuel rail temperature. As a result, direct injection is initiated. Between times t4 and t5, fuel is delivered to a combustion cylinder via direct injection. As fuel rail pressure decreases in response to the direct injection events, Fmin starts to drop.

At t5, Fmin reaches lower threshold 523 and the direct injector is deactivated. From t5 to t6, DI fuel flow is equal to 0. Thus fuel may stagnate in the DI fuel rail, thereby causing an increase in DI fuel rail pressure and a corresponding rise in Fmin.

At t6, Fmin again reaches upper threshold 524, and direct injection is initiated. Additionally at time t6, lower threshold 523 is adjusted based on increasing engine speed. Operation of the direct injection system continues from time t6 to time t7, and the increase in fuel flow through the direct injector is sufficient to reduce the temperature and pressure of the DI fuel rail such that Fmin of the DI fuel rail drops to lower threshold 523. At time t7, the direct injectors are deactivated.

From time t7 to t8, soot load 532 increases, and reaches above upper soot threshold 531. At the same time, Fmin may rise in the DI fuel rail due to stagnating fuel. At time t8, Fmin again reaches upper threshold 524 and direct injection is initiated. Additionally, lower threshold 523 is adjusted based the rising soot load. Operation of the direct injection system continues from time t8, and the increase in fuel flow through the direct injector is sufficient to reduce the temperature and pressure of the DI fuel rail. After t8, fuel may be delivered to the engine cylinder via each of direct injection and port injection.

In one example, a method for an engine comprises: while operating an engine cylinder with fuel from only a first injector, transiently opening a second injector to inject fuel into the cylinder; estimating a mass of the injected fuel mass based on a parameter of the injected fuel; and closing the second injector when the estimated mass is below a lower threshold, the lower threshold adjusted based on one or more engine operating conditions. In the preceding example, the transiently opening may be in response to a fuel pressure increase at a fuel rail coupled to the second injector or in response to the estimated mass being above the lower threshold and below an upper threshold. In any of the preceding examples, the parameter of the injected fuel may include one or more of a pressure and a temperature of the injected fuel. In any of the preceding examples, the upper threshold may be adjusted based on a percentage of total fuel direct injected relative to fuel direct injected when operating a direct injector at a minimum pulse width. In any of the preceding examples having a fuel rail coupled to the second injector, the fuel rail may be a second fuel rail different from a first fuel rail coupled to the first injector. In any or all of the preceding examples, additionally or optionally, each of the first and second fuel rails may be pressurized by a common high pressure fuel pump, wherein during the transiently opening and closing, fuel flow from the high pressure fuel pump to the second fuel rail is disabled. In any of the preceding examples, the lower threshold may be adjusted to remain above a pressure at which the fuel flow from the high pressure fuel pump to the second fuel rail is enabled. Any or all of the preceding examples may additionally or optionally comprise, while the second injector is transiently opened, adjusting injection of fuel from the first injector responsive to fuel injected by the second injector. Therein, the transiently opening may be additionally or optionally further based on a coefficient of thermal expansion of fuel in the second fuel rail. In any or all of the preceding examples having a lower threshold, the lower threshold may be additionally or optionally adjusted based on an estimated soot load, the lower threshold increasing with increasing soot load. In any of the preceding examples, the first fuel injector may be a port injector, and the second fuel injector may be a direct injector. In any or all of the preceding examples, the method may additionally or optionally further adjust a parameter of a cooling system coupled to the fuel rail in response to a rail pressure increase of the fuel rail, the parameter including one of a flow rate and temperature of coolant.

In another example, a method for an engine may comprise: while operating an engine cylinder with only port fuel injection; intermittently injecting fuel stagnating in a direct injection fuel rail into the cylinder, the intermittently injecting including initiating injection when a minimum injection fuel mass of a direct injector reaches an upper threshold and discontinuing the injection when the minimum injection fuel mass falls below a lower threshold, the minimum injection fuel mass estimated based on a temperature and pressure of fuel in the direct injection fuel rail. In the preceding example, the lower threshold may be additionally or optionally adjusted based on engine operating conditions including one or more of exhaust soot level and engine pre-ignition history. In any of the preceding examples, the upper threshold may be additionally adjusted based on a percentage of total fuel which will be injected by the DI system compared to the entire fuel system if the DI system is operated at the minimum pulse width. In any of the above examples where fuel is intermittently injected, the intermittently injecting may additionally or optionally include delivering fuel as a single intake stroke direct injection per cylinder combustion event.

In yet another example, a fuel system for an internal combustion engine may comprise a port fuel injector in communication with a cylinder; a direct fuel injector in communication with the cylinder; a first fuel rail in communication with the port injector; a second fuel rail in communication with the direct injector; a high-pressure fuel pump in communication with each of the first and second fuel rail; and a control system configured with computer-readable instructions stored on non-transitory memory for: estimating an injection mass of fuel injected by the direct injector based on fuel conditions at the second fuel rail; during a first condition, when the estimated injection mass exceeds an upper threshold, increasing fuel flow through the direct fuel injector; during a second condition, when the estimated injection mass drops below a lower threshold, decreasing fuel flow through the direct fuel injector; and during both the first and second conditions, delivering fuel to the cylinder via the port fuel injector. In the preceding system, an inlet of the high pressure fuel pump is additionally or optionally coupled to the first fuel rail, and an outlet of the high pressure fuel pump is coupled to the second fuel rail. In any of preceding examples, the injection mass is additionally or optionally estimated based on each of temperature and pressure of fuel in the second fuel rail, the injection mass increased as any of the temperature and pressure of fuel in the second fuel rail increases.

The technical effect of delivering fuel from the direct injection fuel rail when minimum fuel injection mass of fuel delivered from the DI fuel rail is above a threshold, is that direct injector degradation and fuel metering errors are reduced. By delivering fuel from the DI fuel rail until the pressure at the DI fuel rail reaches a lower threshold such that the minimum injection mass can be maintained within a desired range, engine performance may be improved, especially immediately after a direct injector is enabled. The technical effect of maintaining the minimum fuel injection mass above a level at which fuel flow from the high pressure pump to the DI fuel rail has to be enabled is that NVH issues of the engine can be reduced, while still maintaining the fuel rail pressure at a responsible threshold such that when DI is re-enabled, the minimum DI mass is still reasonable. It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel system for an internal combustion engine, comprising:

a port fuel injector in communication with a cylinder;

a direct fuel injector in communication with the cylinder;

a first fuel rail in communication with the port injector;

a second fuel rail in communication with the direct injector;

a high-pressure fuel pump in communication with each of the first and second fuel rail; and a control system configured with computer-readable instructions stored on non-transitory memory for:

estimating an injection mass of fuel injected by the direct injector based on fuel conditions at the second fuel rail;

during a first condition, when the estimated injection mass exceeds an upper threshold, increasing fuel flow through the direct fuel injector;

during a second condition, when the estimated injection mass drops below a lower threshold, decreasing fuel flow through the direct fuel injector; and during both the first and second conditions, delivering fuel to the cylinder via the port fuel injector.

2. The system of claim 1, wherein an inlet of the high pressure fuel pump is coupled to the first fuel rail, and an outlet of the high pressure fuel pump is coupled to the second fuel rail.

3. The system of claim 1, wherein the injection mass is estimated based on each of temperature and pressure of fuel in the second fuel rail, the injection mass increased as any of the temperature and pressure of fuel in the second fuel rail increases.

4. A method, comprising:

while operating an engine cylinder with fuel from only a first injector, transiently opening a second injector to inject fuel into the cylinder;

estimating a mass of the injected fuel mass based on a parameter of the injected fuel; and closing the second injector when the estimated mass is below a lower threshold, the lower threshold adjusted based on one or more engine operating conditions.

5. The method of claim 4, wherein the transiently opening is in response to a fuel pressure increase at a fuel rail coupled to the second injector.

6. The method of claim 4, wherein the parameter of the injected fuel includes one or more of a pressure and a temperature of the injected fuel.

7. The method of claim 4, wherein the transiently opening is in response to the estimated mass being above the lower threshold and below an upper threshold.

8. The method of claim 4, wherein the upper threshold is based on a percentage of total fuel injected by the direct injector system relative to fuel injected by the direct injector when operated at a minimum pulse width.

9. The method of claim 4, wherein the fuel rail coupled to the second injector is a second fuel rail different from a first fuel rail coupled to the first injector.

10. The method of claim 9, wherein each of the first and second fuel rails are pressurized by a common high pressure fuel pump, and wherein during the transiently opening and closing, fuel flow from the high pressure fuel pump to the second fuel rail is disabled.

11. The method of claim 10, wherein the lower threshold is adjusted to remain above a pressure at which the fuel flow from the high pressure fuel pump to the second fuel rail is enabled.

12. The method of claim 4, further comprising, while the second injector is transiently opened, adjusting injection of fuel from the first injector responsive to fuel injected by the second injector.

13. The method of claim 4, wherein the transiently opening is further based on a coefficient of thermal expansion of fuel in the second fuel rail.

14. The method of claim 4, wherein the lower threshold is adjusted based on an estimated soot load, the lower threshold increasing with increasing soot load.

15. The method of claim 4, wherein the first fuel injector is a port injector, and the second fuel injector is a direct injector.

16. The method of claim 4, further comprising adjusting a parameter of a cooling system coupled to the fuel rail in response to a rail pressure increase of the fuel rail, the parameter including one of a flow rate and temperature of coolant.

17. A method for an engine comprising:

while operating an engine cylinder with only port fuel injection;

intermittently injecting fuel stagnating in a direct injection fuel rail into the cylinder, the intermittently injecting including initiating injection when a minimum injection fuel mass of a direct injector reaches an upper threshold and discontinuing the injection when the minimum injection fuel mass falls below a lower threshold, the minimum injection fuel mass estimated based on a temperature and pressure of fuel in the direct injection fuel rail.

18. The method of claim 17, wherein the lower threshold adjusted based on engine operating conditions including one or more of exhaust soot level and engine pre-ignition history.

19. The method of claim 17, wherein the upper threshold is adjusted based on a percentage of total fuel direct injected relative to fuel direct injected when operating a direct injector at a minimum pulse width.

20. The method of claim 17, wherein the intermittently injecting includes delivering fuel as a single intake stroke direct injection per cylinder combustion event.

* * * * *